US008333294B2

(12) United States Patent
Forrest et al.

(10) Patent No.: US 8,333,294 B2
(45) Date of Patent: Dec. 18, 2012

(54) CAP FOR A LUG-TYPE CLOSURE

(75) Inventors: Randall G. Forrest, Park Ridge, IL (US); Timothy L. Turner, Port Charlotte, FL (US)

(73) Assignee: Rexam Beverage Can Company, Chicago, IL (US)

( * ) Notice: Subject to any disclaimer, the term of this patent is extended or adjusted under 35 U.S.C. 154(b) by 496 days.

(21) Appl. No.: 12/255,291

(22) Filed: Oct. 21, 2008

(65) Prior Publication Data

US 2010/0096356 A1 Apr. 22, 2010

(51) Int. Cl.
*B65D 41/00* (2006.01)

(52) U.S. Cl. ..... 220/310.1; 215/317

(58) Field of Classification Search ..... 215/317, 215/324, 327, 316, 45, 43, 200; 53/487, 53/485, 484, 476; *B65D 41/16, 41/02, 41/00*
See application file for complete search history.

(56) References Cited

U.S. PATENT DOCUMENTS

| | | | | | |
|---|---|---|---|---|---|
| 1,035,634 | A | * | 8/1912 | Platt | 220/794 |
| 1,703,573 | A | | 2/1929 | Carvalho | |
| 1,858,826 | A | * | 5/1932 | Holland | 215/317 |
| 2,007,257 | A | | 7/1935 | Scofield | |
| 2,337,616 | A | | 12/1943 | McManus et al. | |
| 2,445,647 | A | | 7/1948 | Thomas | |
| 3,071,275 | A | * | 1/1963 | Foss et al. | 215/317 |
| 3,133,656 | A | * | 5/1964 | Foster | 215/317 |
| 3,219,004 | A | | 11/1965 | Wilton | |
| 3,270,904 | A | | 9/1966 | Foster et al. | |
| 3,460,703 | A | * | 8/1969 | Leftault, Jr. | 215/252 |
| 3,704,677 | A | | 12/1972 | Moller | |
| 3,844,443 | A | | 10/1974 | Cudzik | |
| 3,868,038 | A | * | 2/1975 | Hadley | 215/305 |
| 3,967,746 | A | * | 7/1976 | Botkin | 215/260 |
| 4,341,324 | A | * | 7/1982 | Ramirez | 220/796 |
| 4,452,365 | A | | 6/1984 | Ascasibar-Verdejo | |
| 5,322,177 | A | | 6/1994 | Coggins | |
| 6,015,062 | A | * | 1/2000 | Bachmann et al. | 220/295 |
| 6,082,944 | A | | 7/2000 | Bachmann et al. | |
| 6,959,830 | B1 | | 11/2005 | Kanou et al. | |

(Continued)

FOREIGN PATENT DOCUMENTS

| | | |
|---|---|---|
| DE | 1432117 | 11/1968 |
| GB | 396245 | 8/1933 |
| NL | 8400752 | 10/1985 |

OTHER PUBLICATIONS

Rexam Beverage Can Company, International Search Report from co-pending Application No. PCT/US2009/061323 mailed Jan. 21, 2010.

*Primary Examiner* — Mickey Yu
*Assistant Examiner* — Robert J Hicks
(74) *Attorney, Agent, or Firm* — Ungaretti & Harris LLP

(57) ABSTRACT

A cap for sealing a container has a top panel and a circumferential side wall panel. The top panel is positioned about a longitudinal axis and extends radially outwardly therefrom. The circumferential side wall panel is integral with an outer peripheral edge of the top panel and has first second, and third segments. The first segment extends downwardly. The second segment extends radially outwardly at a first angle to the first segment. The third segment extends downwardly from the second segment at a second angle to the second segment. The cap has lug members for sealing the cap to a container having corresponding lugs.

20 Claims, 6 Drawing Sheets

U.S. PATENT DOCUMENTS

| | | | | |
|---|---|---|---|---|
| 7,171,840 | B2 | 2/2007 | Kanou et al. | |
| 2005/0051554 | A1 | 3/2005 | Cook et al. | |
| 2005/0115294 | A1 | 6/2005 | Kanou et al. | |
| 2005/0138984 | A1* | 6/2005 | Cook et al. | 72/361 |
| 2006/0011633 | A1 | 1/2006 | Cook et al. | |
| 2006/0016821 | A1* | 1/2006 | Liu | 220/780 |
| 2006/0113273 | A1* | 6/2006 | Kristensen | 215/316 |
| 2007/0062952 | A1 | 3/2007 | Kobayashi et al. | |

* cited by examiner

CAP FOR A LUG-TYPE CLOSURE

CROSS-REFERENCE TO RELATED APPLICATIONS

Not applicable at the time of filing.

TECHNICAL FIELD

The invention relates to beverage containers having resealable closures. More particularly, the present invention relates to closure caps for a seamable can end member having a lug-type closure assembly.

BACKGROUND OF THE INVENTION

Screw-on cap closures are known in the metal beverage container art. An open end of the container may be opened and resealed using the screw-on closure cap. A number of references teach such screw-on closure caps with many different features achieving differing levels of success.

One method involves production of a can body having a necked-in upper portion terminating at a threaded open end. These containers generally resemble screw top bottles. The threads are typically mechanically formed using the excess metal at the open end of the can body. Formation of the threads, however, is a difficult manufacturing process.

Recently, lug-type resealable closure systems have been introduced into the beverage market. Such closures are described in U.S. Pat. No. 6,082,944, issued to Bachman et al. These closure systems include a set of elongated lugs located about the container at an upper neck portion. These lugs cooperate with a second set of inwardly extending lug members formed in a curled rim of a cap member. When the cap member is attached to the upper neck portion, the cooperating lug members draw the cap against a curled seal rim of the container. These closure systems overcome some of the drawbacks of the threaded closures because the relatively expensive operation of threading the wall of the container body is avoided, and these types of closure systems enable the use of a container which has a very short skirt and therefore requires less material than the relatively long-skirted caps usually employed as a screw closure.

However, these types of closures often will not seal the open end of the container particularly well. Several cap variations have been introduced with mixed results. To date, no lug-type cap closure has performed well enough to meet a wide variety of end user requirements. Therefore, a lug-type closure system that can be reliably manufactured while overcoming the problems associated with fully threaded closures while providing a resealable closure cap is needed.

The present invention is provided to solve the problems discussed above and other problems, and to provide advantages and aspects not provided by prior closure caps of this type. A full discussion of the features and advantages of the present invention is deferred to the following detailed description, which proceeds with reference to the accompanying drawings.

SUMMARY OF THE INVENTION

One aspect of the present invention is directed to a cap for sealing a container having a lug-type closure assembly. The cap comprises a top panel positioned about a longitudinal axis and extends radially outwardly therefrom. A circumferential side wall panel is integral with an outer peripheral edge of the top panel and comprises a first segment extending downwardly, a second segment extending radially outwardly at a first angle to the first segment, and a third segment extending downwardly from the second segment at a second angle to the second segment. The cap may further comprise a sealing material located within the cap on an inner side of the top panel. The sealing material may terminate at an intersection between the top panel and the circumferential side wall.

The circumferential side wall of this aspect of the invention may be threadless. The circumferential side wall may further comprise a mating lug for cooperative engagement with a sealing lug located on a neck. The circumferential side may have a plurality of mating lugs for cooperative engagement with a plurality of sealing lugs located on a neck of a can end. At least a portion of the circumferential side wall may terminate in a radially outwardly formed curl which forms the mating lugs. Accordingly, a portion of the radially outwardly formed curl may be located radially inwardly of a lowermost end of the third segment joined to the curl.

The first segment of the circumferential side wall of this aspect of the invention may extend downwardly substantially parallel to the longitudinal axis.

The second segment of the circumferential side wall of this aspect of the invention may further extend downwardly relative to the first segment wherein the first angle as measured from an axis parallel to the longitudinal axis is less than 90 degrees and greater than 0 degrees. The angle may be less than or equal to 60 degrees and greater than or equal to 20 degrees. A length of the second segment may be greater than a length of the first segment.

The third segment of the circumferential side wall may have an upper portion joined to the second segment which is substantially parallel to the longitudinal axis.

Further to this aspect of the invention, the first segment may be separated from the second segment by a concave bend having a center of curvature located radially outwardly of the concave bend. The second segment may be separated from the third segment by a convex bend having a center of curvature located radially inwardly of the convex bend.

The top panel of this aspect of the invention may include a recessed countersink located radially inwardly of the outer peripheral edge of the top panel. The countersink may be annular and may further have a U-shaped cross-section. A portion of the top panel located radially inwardly from the annular recessed countersink may be located below a height of the outer peripheral edge of the top panel.

A portion of the top panel located radially inwardly from the outer peripheral edge of the top panel may be recessed below the outer peripheral edge. The top panel may include an annular top panel wall joining the recessed portion of the top panel with the outer peripheral edge of the top panel. The annular top panel wall extends upwardly and radially outwardly relative to the longitudinal axis. Alternatively, the annular top panel wall extends upwardly and substantially parallel to the longitudinal axis.

A second aspect of the present invention is directed to a cap for sealing a container having a lug-type closure assembly. The cap comprises a top panel and a circumferential side wall. The top panel is positioned about a longitudinal axis and extends radially outwardly therefrom. The top panel comprises an outer peripheral edge joined to a recessed central portion by an annular wall substantially parallel to the longitudinal axis. The circumferential side wall panel is integral with the outer peripheral edge of the top panel.

A third aspect of the present invention is directed to a cap having lug-type closure assembly comprising a top panel and a circumferential side wall. The top panel is positioned about a longitudinal axis and extends radially outwardly therefrom.

The top panel comprises an outer peripheral edge joined to a remaining portion of the top panel by a countersink. The circumferential side wall panel is integral with the outer peripheral edge of the top panel. The countersink may be U-shaped.

A fourth aspect of the present invention is directed to A cap for sealing a container having a lug-type closure assembly. The cap comprises a top panel and a circumferential side wall. The top panel is positioned about a longitudinal axis and extends radially outwardly therefrom. The circumferential side wall is integral with an outer peripheral edge of the top panel and comprises comprising a segment extending downwardly and radially outwardly relative to the longitudinal axis. The segment is bounded at one end by a circumferential concave bend at an uppermost extent and bounded at an opposite end by a first circumferential convex bend at a lowermost extent. The segment comprises a second circumferential convex bend located between the concave bend and the first convex bend. The second convex bend has a radius of curvature greater than a radius of curvature of the concave bend and the radius of curvature of the first convex bend.

A fifth aspect of the present invention is directed to a cap for sealing a container having a lug-type closure assembly. The cap comprises a top panel and a circumferential side wall. The top panel is positioned about a longitudinal axis and extends radially outwardly therefrom. The circumferential side wall panel is integral with an outer peripheral edge of the top panel and comprises a first segment extending downwardly separated from a second segment by a concave bend wherein the circumferential side wall panel terminates at a curl and the first and second segments are located between an uppermost portion of the circumferential side wall and the curl.

A sixth aspect of the present invention is directed to a cap for sealing a container having a lug-type closure assembly. The cap comprises a top panel and a circumferential side wall. The top panel is positioned about a longitudinal axis and extends radially outwardly therefrom. The circumferential side wall panel is integral with an outer peripheral edge of the top panel and comprises a segment angling downwardly and outwardly relative to the longitudinal axis and located between a pair of outwardly convex bends, the segment having a further outwardly convex bend having a substantially greater radius of curvature than either of the pair of outwardly convex bends.

A seventh aspect of the present invention is directed to a beverage can. The beverage can comprises a circumferential side wall, a bottom wall, a top wall, and a cap. The circumferential container side wall is positioned about a longitudinal axis. The bottom wall is integral with the side wall. The top wall comprises an upwardly extending reduced diameter neck having a plurality of radially outwardly extending lugs. The neck terminates at a curl defining a dispensing aperture. The cap seals the dispensing aperture and comprises a top panel and a segment angling downwardly and outwardly relative to the longitudinal axis. The top panel is positioned about the longitudinal axis and extends radially outwardly therefrom. The angled portion is located between a pair of outwardly convex bends. The angled portion has a further outwardly convex bend having a substantially greater radius of curvature than either of the pair of outwardly convex bends.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
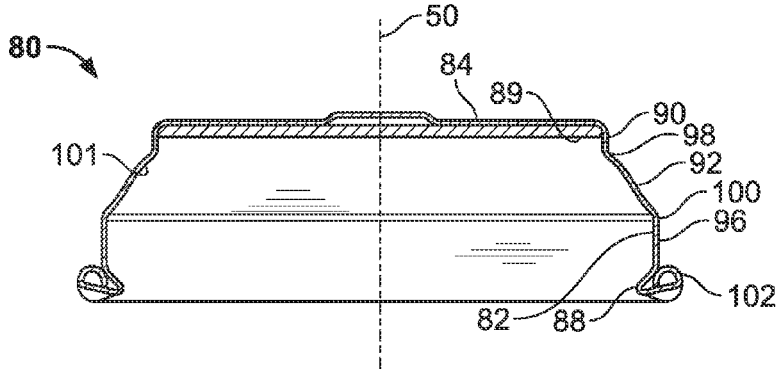
FIG. 1 is a cross-sectional view of a first embodiment cap closure of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1-8, can ends 10 for containers are illustrated. Each can end 10 has a seaming curl 12, a chuck wall 14, annular strengthening member 16, and a center or central panel wall 18. The can ends 10 may be seamed to close a can body 19 as illustrated in FIG. 9.

The seaming curl 12 defines the outer perimeter of the can end 10. The seaming curl 12 is provided for joining the can end 10 to a filled can body during a seaming process which is generally the standard means of joining can ends with can bodies used in the beverage industry today.

The chuck wall 14 extends downwardly and radially inwardly from the seaming curl 12. The chuck wall 14 may or may not include elements for strengthening the overall integrity of the can end.

The annular strengthening member 16 joins the chuck wall with the center panel 18. The annular strengthening member 16 may be a countersink as shown in the Figures, or the annular strengthening member 16 may be a fold or any other structure which serves to strengthen the can end without departing from the spirit of the invention disclosed herein.

The center panel 18 is centered about a vertical center or longitudinal axis 50. The center panel includes a dispensing aperture or opening 60, generally centered on the panel 18. The opening 60 is elevated above the peripheral edge 20 of the center panel 18 by an upwardly extending circumferential neck 68.

The neck 68, which terminates at the opening 60, has a circumferential shoulder 72. The shoulder 72 smoothly reduces the diameter of the neck 68 so that the diameter of the opening 60 is smaller than the diameter of a lowermost extent of the neck 68. This shoulder 72 is generally arcuate having a radius of curvature with a center of curvature located radially inwardly of the shoulder 72. The shoulder 72 terminates at a flange 76, preferably a curled portion of the neck 68 which defines the opening 60. This curl is formed such that it forms an annular tube, as differentiated from the seaming curl 12 which represents more of a hook-like structure.

Along a generally cylindrical skirt portion of the neck 68, positioned below the shoulder 72, is a lug-type closure assembly. This assembly includes a plurality of radially outwardly extending lug members 77 The lug members 77 are preferably equally spaced about the circumference of the cylindrical portion of the neck 68 and have a generally elongated, curvilinear shape. More particularly, the lug members 77 preferably have a leading portion angled upwardly toward the opening 60, an intermediate portion that is substantially linear along a horizontal plane, and a trailing portion that is angled downwardly relative to the opening 60.

A cap 80 is provided to seal the opening. The cap 80 includes a side wall portion 82 closed at one end by a top panel 84. An inner wall of the side wall portion 82 is threadless, instead having one or more radially inwardly extending mating lugs 88, preferably a plurality of spaced mating lugs 88 corresponding to the number of lug members 77 on the neck 68. In use, the cooperating mating lugs 88 of the cap 80 and the lug members 77 of the neck 68 draw the top panel 82 against the curled flange 76 of the neck 68. The seal is generally an annular O-ring 89 molded as a peripheral part of a thin polymeric disk which is attached to the underside of top panel 84.

As illustrated in FIGS. 1-8 each side wall 82 associated with the caps 80 of the present invention has a three-part structure unlike any known in the art. The circumferential side wall panel 82 is integral with an outer peripheral edge of the top panel 84 and has a first segment 90 extending downwardly, a second segment 92 extending radially outwardly at a first angle to the first segment 90, and a third segment 96 extending downwardly from the second segment 92 at a second angle to the second segment 92. The seal material terminates at an intersection between the top panel 84 and the side wall 82.

The first segment 90 of the circumferential side wall extends downwardly and preferably extends downwardly and substantially parallel to the longitudinal axis 50 such that an inner surface of the first segment lies adjacent a radially outer portion of the flange 76. The first segment 90 is preferably circumferential.

The second segment 92 is also preferably circumferential. The second segment 92 has a greater length than a length of the first segment 90. The second segment 92 is separated from the first segment 90 by a concave bend 98 having a center of curvature located radially outwardly of the concave bend 98. The second segment 92 is separated from the third segment 96 by a convex bend 100 having a center of curvature located radially inwardly of the convex bend 100. The angle of the second segment 92 (i.e., the first angle described above) as measured from an axis parallel to the longitudinal axis 50 is less than 90 degrees and greater than 0 degrees, more preferably the first angle is less than or equal to 60 degrees and greater than or equal to 20 degrees, or any range or combination of ranges therein.

The second segment 92 preferably has a shape for improved sealing with the center panel 18. Located between the concave bend 98 and the first convex bend 100 is a second convex bend 101. This second convex bend has a radius of curvature much greater than the radii of curvature of either concave bend 98 or the first convex bend 100. The center of curvature of the second convex bend 101 is located radially inwardly of the second convex bend 101. The location of the second convex bend 101 and its radius of curvature are adapted, as in sized, shaped, and located, to coincide with a portion of the shoulder 72 of the center panel 18 for improved sealing against the shoulder if so desired. In other words, one aspect of the present invention is to improve sealing of the cap 80 against the can end 10 by compressing a seal against an arcuate upper portion of the shoulder 72. Sealing material, such as an O-ring, may be located in this region of the second segment 92 to further improve sealing of a container.

Stated another way, the circumferential sidewall 82 has an angled portion located between a pair of convex bends. The lower of the two convex bends is the convex bend 100 between the second and third segments 92,96. The upper of the two convex bends is a bend created at the transition between the top panel 84 and the sidewall 82 where the cap 80 wraps around the flange 75. This bend separates the top panel 84 from the first segment 90 of the sidewall 82. This angled portion preferably extends both downwardly and outwardly relative to the longitudinal axis 50, and preferably includes the concave bend 98 along its length. Also included along the length of this angled portion is the second convex bend 101. The second convex bend 101 has a radius of curvature much greater than the other bends and substantially matches the radius of curvature of the upper arcuate shoulder 72 to provide improved sealing therewith.

The third segment 96 is also preferably circumferential. Much of the third segment 96 is generally vertical or parallel to the longitudinal axis along much of its length wherein the third segment 96 has an upper portion which is substantially parallel to the longitudinal axis and joined to the second segment 92. However, at least portions of the circumferential third segment 96 terminate at a radially outwardly formed curl 102. The phrase "radially outwardly formed" in this case is merely intended to indicate the radial directed in which a circumferential edge of the side wall 82 is deformed in order to create the curl 102. This curl 102 also forms an annular tube, portions of which are reformed or flattened to form the mating lugs 88. A portion of the radially outwardly formed curl 102 is located radially inwardly of a lowermost end of the third segment joined to the curl 102. This structure forms the mating lugs 88.

Figure 2:
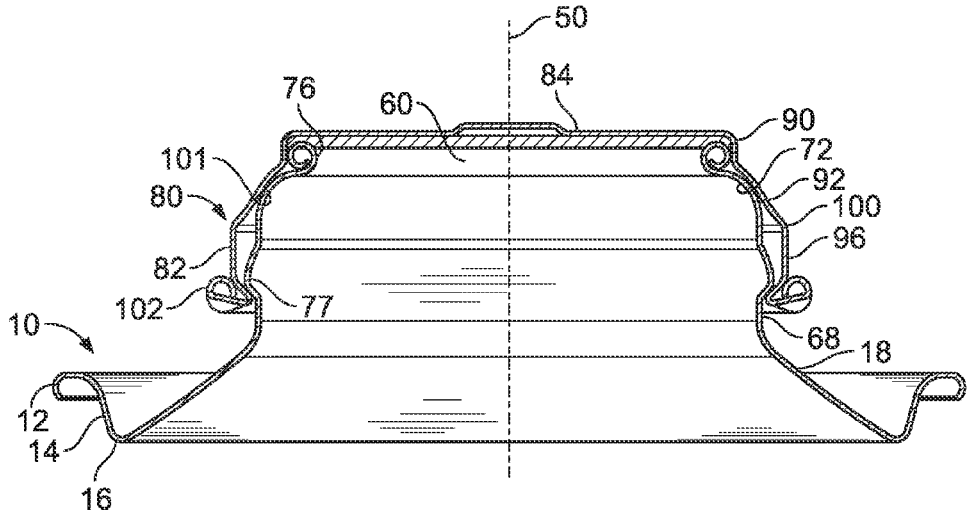
FIG. 2 is a cross-sectional view of a can end incorporating the first embodiment cap closure.
Figure 3:
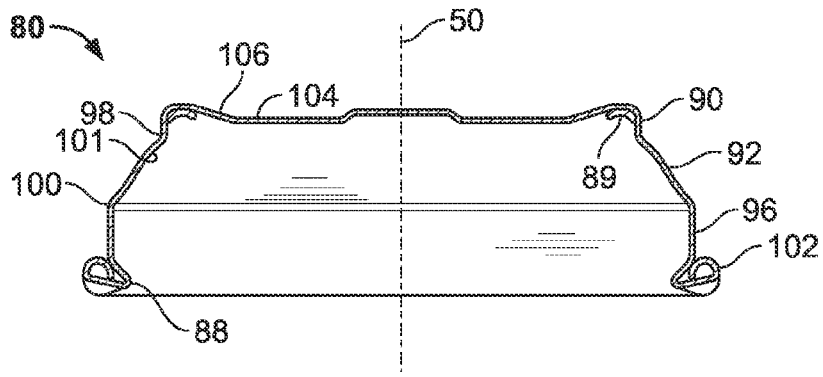
FIG. 3 is a cross-sectional view of a second embodiment cap closure of the present invention.
Figure 4:
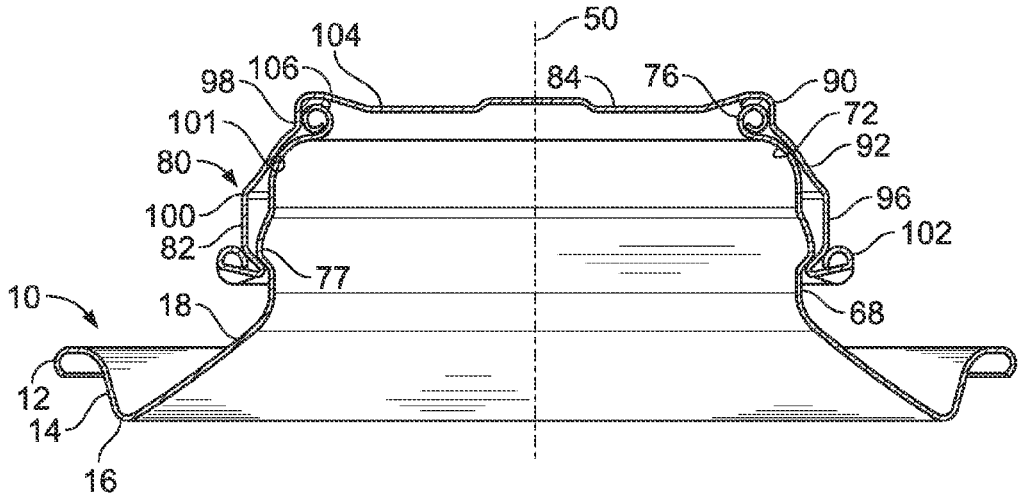
FIG. 4 is a cross-sectional view of a can end incorporating the second embodiment cap closure.

In the embodiment illustrated in FIGS. 3 and 4, in addition to the features described in conjunction with FIGS. 1 and 2, the top panel 84 has a recessed countersink 104 located radially inwardly from the peripheral edge of the top panel 84. A radially outer annular wall 106 of the countersink 104 angles downwardly and radially inwardly relative to the longitudinal axis 50. The annular wall 106 creates a vertical displacement of the countersink 104 that is greater than twenty-five percent of a vertical displacement created by the first segment 90. The combination of the first segment 90 of the side wall 82 and the outer annular wall 106 forms an annular channel for receiving the flange 76 therein. An o-ring sealing material is located within the channel.

Figure 5:
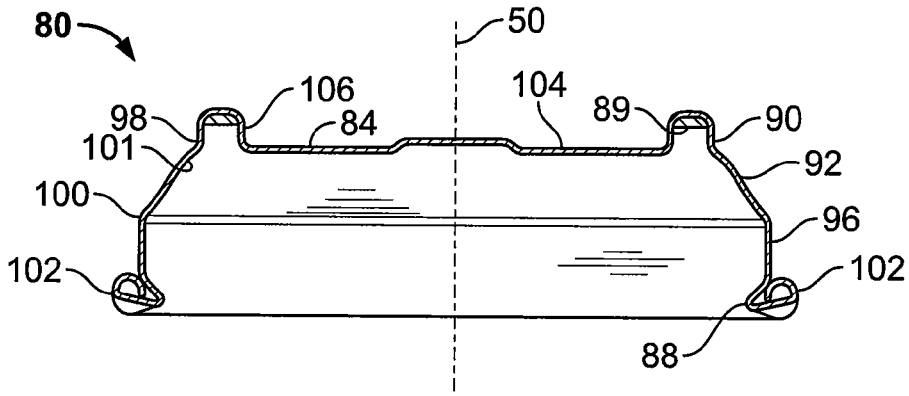
FIG. 5 is a cross-sectional view of a third embodiment cap closure of the present invention.
Figure 6:
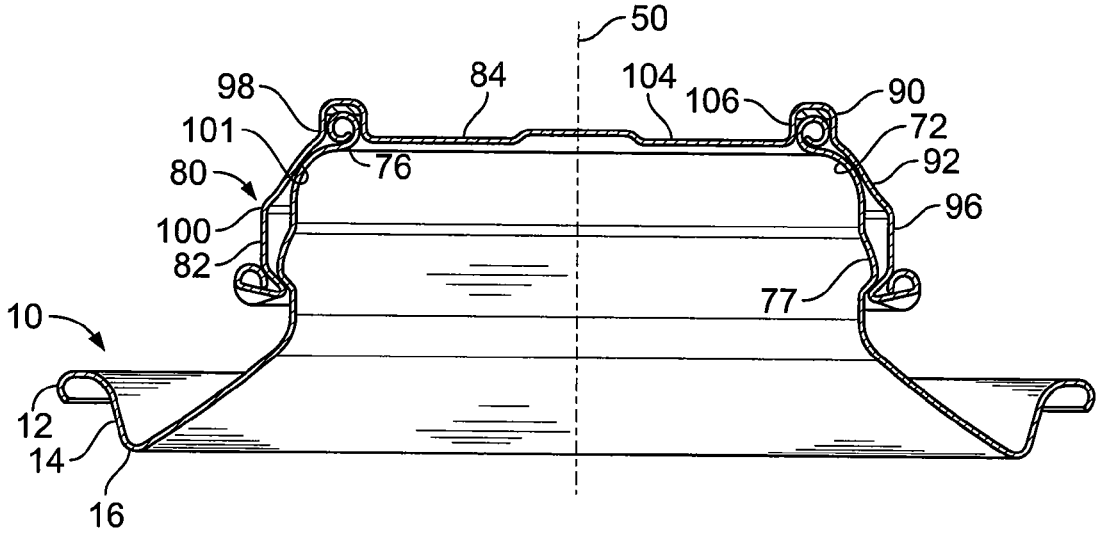
FIG. 6 is a cross-sectional view of a can end incorporating the third embodiment cap closure.
Figure 7:
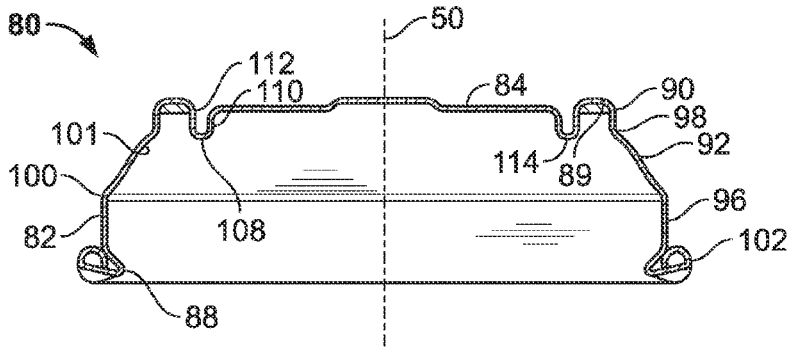
FIG. 7 is a cross-sectional view of a fourth embodiment cap closure of the present invention.

In the embodiment illustrated in FIGS. 5 and 6, in addition to the features described in conjunction with FIGS. 1 and 2, the radially outer annular wall 106 of the countersink 104 is substantially vertical and parallel to the longitudinal axis 50. Here, the annular wall 106 creates a vertical displacement of the countersink 104 that is greater than twenty-five percent of a vertical displacement created by the first segment 90, preferably equal to or greater than the total vertical displacement created by the first segment 90. The combination of the first segment 90 of the side wall 82 and the outer annular wall forms a deep annular channel having parallel annular walls of the first segment 90 of the cap side wall 82 and the outer annular wall 106 of the top panel 80. The channel is adapted, as in sized and shaped, to receive the flange 76 therein. An o-ring sealing material is located within the channel.

Figure 8:
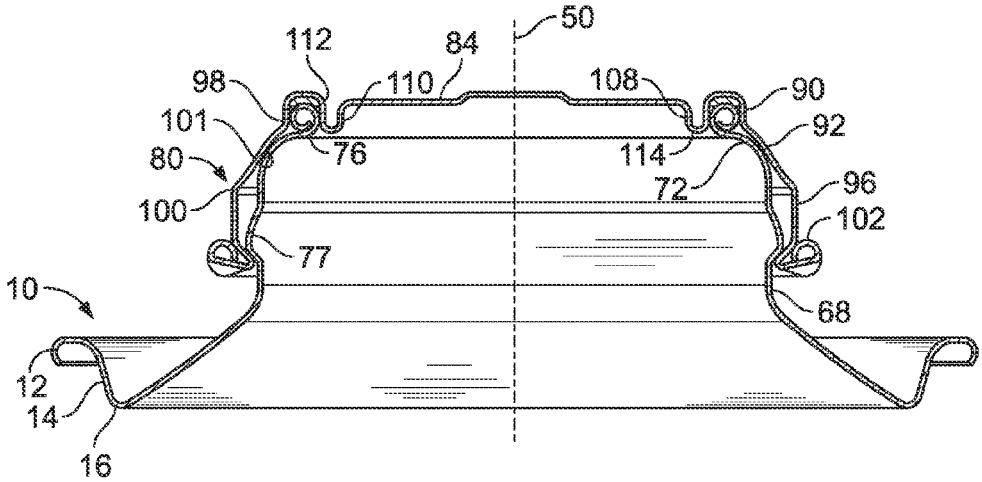
FIG. 8 is a cross-sectional view of a can end incorporating the fourth embodiment cap closure.
Figure 9:
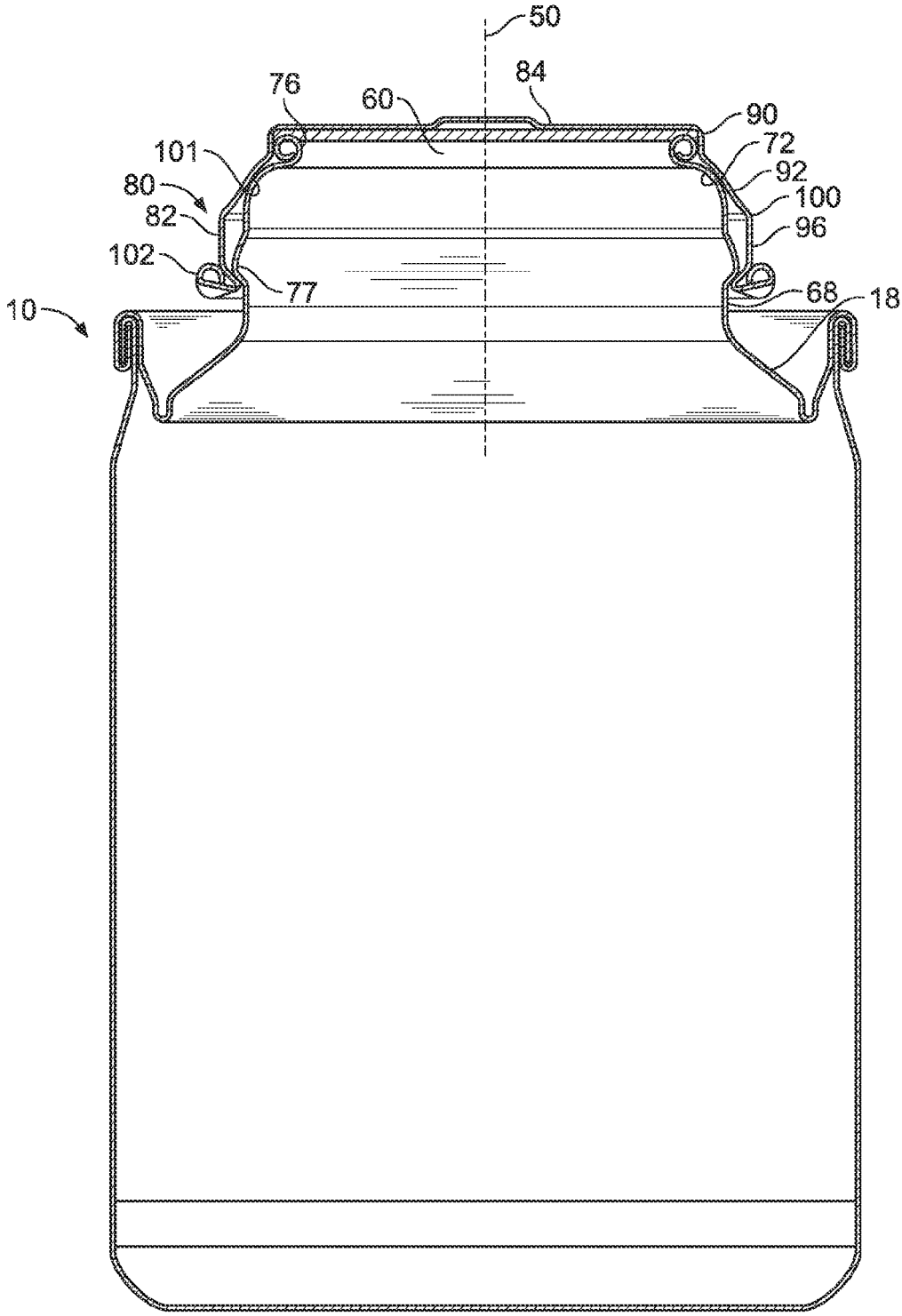
FIG. 9 is a cross-sectional of a container view of a can end seamed to a container body.

In the embodiment illustrated in FIGS. 8 and 9, in addition to the features described in conjunction with FIGS. 1 and 2, the top panel 80 includes an annular recessed countersink 108. This countersink 108 is generally U-shaped. Accordingly, the countersink 108 has substantially parallel radially inner and outer annular walls 110, 112 joined by an annular arcuate segment 114. The outer annular wall 112 creates a vertical displacement of the countersink 108 that is greater than twenty-five percent of a vertical displacement created by the first segment 90, preferably equal to or greater than the total vertical displacement created by the first segment 90. A portion of the top panel 80 located radially inwardly from the annular recessed countersink 108 is located below a height of the outer peripheral edge of the top panel 80. A combination of the outer annular wall 112 and the first segment 90 of the cap side wall 82 forms a channel for receiving the flange 76 therein. An o-ring sealing material again is located within the channel.

The lug-type closure assembly provides advantages over prior art threaded closures. First, the cap 80 of the lug-type closure assembly is easier to reseal on the can end 10. Threaded caps requires several turns to reseal a beverage within the containment vessel; the lug-type assembly only requires a partial turn dictated by the length of the linear portion of the lug member on the neck. Second, the lug-type assembly is easier to manufacture because the lugs can be larger than typical threads, and the lugs do not need to spiral about the entire circumference of the neck and/or vertically overlap like typical threads. Third, the lug-type assembly does not require an annular ring from which the cap must be separated to open the container or perforated metal tabs to form a seal with the can end.

Figure 10:
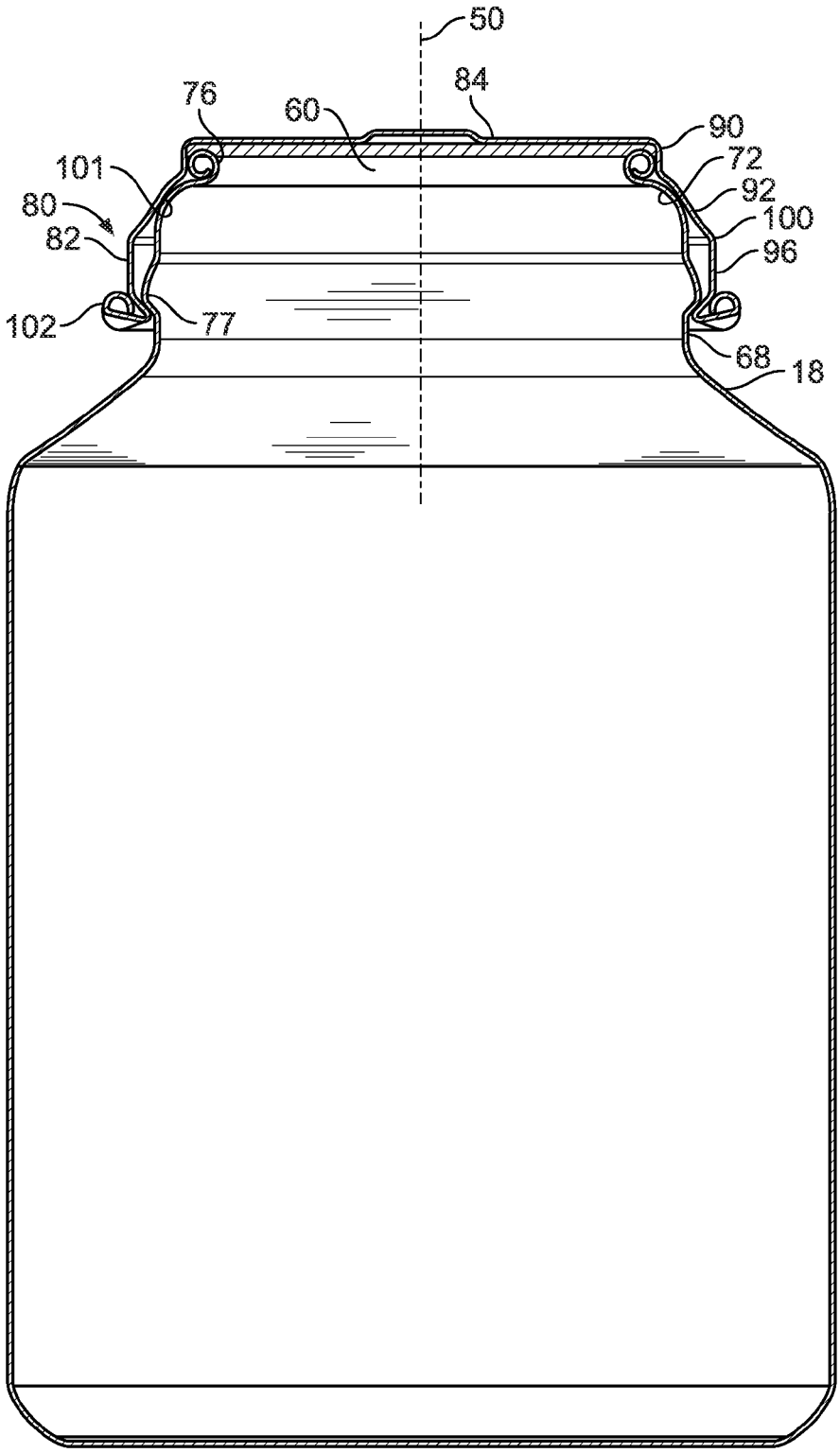
FIG. 10 is a cross-sectional of a container wherein an end portion including the opening is integral with a container side wall.

Alternatively, as shown in FIG. 10, a can body may include an integral end portion wherein seaming is unnecessary.

One of ordinary skill in the art would appreciate that the terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "attached," "joined," and/or "connected" as used herein are intended to put or bring two elements together so as to form a unit, and any number of elements, devices, fasteners, etc. may be provided between the joined or connected elements unless otherwise specified by the use of the term "directly" and/or supported by the drawings. Finally, the term "concave," when used to modify the term "bend," is intended to describe a formation as relative to a radially outer (or public) surface; the term "convex," when used in the same manner is also intended to describe a formation relative to the radially outer surface.

While the specific embodiments have been illustrated and described, numerous modifications come to mind without significantly departing from the spirit of the invention, and the scope of protection is only limited by the scope of the accompanying Claims.

What is claimed is:

1. A cap for sealing a container having a closure assembly comprising lug members on the container for sealing with corresponding lugs on the cap, the cap comprising:

a top panel positioned about a longitudinal axis and extending radially outwardly therefrom; and a circumferential side wall integral with an outer peripheral edge of the top panel comprising a first segment extending downwardly, a second segment extending radially outwardly at a first angle to the first segment, and a third segment extending downwardly from the second segment at a second angle to the second segment wherein the circumferential side wall comprises an angled portion extending downwardly and outwardly relative to the longitudinal axis and located between a pair of outwardly convex bends, the angled portion having a further outwardly convex bend having a substantially greater radius of curvature than either of the pair of outwardly convex bends.

2. The cap of claim 1 further comprising a sealing material located within the cap on an inner side of the top panel, the sealing material terminating at an intersection between the top panel and the circumferential side wall.

3. The cap of claim 1 wherein the first segment of the circumferential side wall extends downwardly substantially parallel to the longitudinal axis.

4. The cap of claim 1 wherein the second segment further extends downwardly relative to the first segment wherein the first angle as measured from an axis parallel to the longitudinal axis is less than 90 degrees and greater than 0 degrees.

5. The cap of claim 4 wherein the angle is less than or equal to 60 degrees and greater than or equal to 20 degrees.

6. The cap of claim 1 wherein the circumferential side wall is threadless.

7. The cap of claim 1 wherein the circumferential side wall comprises a plurality of mating lugs for cooperative engagement with a plurality of sealing lugs located on a neck of the container.

8. The cap of claim 1 wherein the third segment has an upper portion joined to the second segment which is substantially parallel to the longitudinal axis.

9. The cap of claim 1 wherein a length of the second segment is greater than a length of the first segment.

10. The cap of claim 1 wherein at least a portion of the circumferential side wall terminates in a radially outwardly formed curl and the first, second and third segments of the sidewall are located between the curl and an uppermost vertical extent of the sidewall.

11. The cap of claim 10 wherein a portion of the radially outwardly formed curl is located radially inwardly of a lowermost end of the third segment joined to the curl.

12. The cap of claim 1 wherein the further outwardly convex bend is located on the second segment.

13. The cap of claim 1 wherein the top panel includes a recessed countersink located radially inwardly of the outer peripheral edge of the top panel.

14. The cap of claim 1 wherein the top panel includes an annular recessed countersink located radially inwardly from the outer peripheral edge of the top panel.

15. The cap of claim 14 wherein the annular recessed countersink is u-shaped.

16. The cap of claim 14 wherein a portion of the top panel located radially inwardly from the annular recessed countersink is located below a height of the outer peripheral edge of the top panel.

17. The cap of claim 1 wherein a recessed portion of the top panel located radially inwardly from the outer peripheral edge of the top panel is recessed below the outer peripheral edge.

18. The cap of claim 17 wherein the top panel includes an annular top panel wall joining the recessed portion of the top panel with the outer peripheral edge of the top panel, the annular top panel wall extending upwardly and radially outwardly relative to the longitudinal axis.

19. The cap of claim 17 wherein the top panel includes an annular top panel wall joining the recessed portion of the top panel with the outer peripheral edge of the top panel, the annular top panel wall extending upwardly and substantially parallel to the longitudinal axis.

20. A cap and can end assembly for sealing a container, the assembly comprising:

a can end comprising:

a curl defining an outer perimeter of the can end;

a wall extending downwardly and radially inwardly from the curl;

an annular strengthening member joining the wall with a center panel wherein the center panel includes a dispensing aperture generally centered on the center panel and defined by a flange, the dispensing aperture is elevated above a peripheral edge of the center panel by an upwardly extending circumferential neck, the circumferential neck has a circumferential shoulder which reduces a diameter of the circumferential neck wherein a diameter of the dispensing aperture is smaller than a diameter of a lowermost extent of the neck, the shoulder generally having an arcuate shape and a radius of curvature having a center of curvature located radially inwardly of the shoulder, the circumferential neck further having a generally cylindrical skirt portion positioned below the shoulder having a plurality of radially outwardly extending lug members; and a cap covering the dispensing aperture comprising:

a top panel positioned about a longitudinal axis and extending radially outwardly therefrom, the top panel comprising an outer peripheral edge joined to a recessed central portion by an annular wall;

a seal material engaging the top panel and the flange defining the dispensing aperture; and a circumferential side wall integral with the outer peripheral edge of the top panel comprising a first segment extending downwardly, a second segment extending radially outwardly at a first angle to the first segment, and a third segment extending downwardly from the second segment at a second angle to the second segment wherein the circumferential side wall further comprises a plurality of mating lugs for cooperative engagement with the outwardly extending lug members of the cylindrical skirt portion of the can end and wherein the second segment comprises a convex bend having a radius of curvature substantially matching the radius of curvature of the arcuate shape of the shoulder of the can end to provide improved sealing of the assembly therewith.

* * * * *